US009422798B2

(12) United States Patent
Parsche

(10) Patent No.: US 9,422,798 B2
(45) Date of Patent: Aug. 23, 2016

(54) HYDROCARBON RESOURCE HEATING APPARATUS INCLUDING FERROMAGNETIC TRANSMISSION LINE AND RELATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 550 days.

(21) Appl. No.: 13/934,867

(22) Filed: Jul. 3, 2013

(65) Prior Publication Data

US 2015/0007974 A1 Jan. 8, 2015

(51) Int. Cl.
*E21B 43/24* (2006.01)
*E21B 36/04* (2006.01)

(52) U.S. Cl.
CPC ..... *E21B 43/2401* (2013.01); *E21B 36/04* (2013.01)

(58) Field of Classification Search
CPC ..... E21B 36/00; E21B 36/04; E21B 41/0085; E21B 43/24; E21B 43/2401
See application file for complete search history.

(56) References Cited

U.S. PATENT DOCUMENTS 3,501,753 A * 3/1970 Kornreich ..... H01F 10/06 307/415
RE30,738 E * 9/1981 Bridges ..... E21B 36/04 166/245
4,583,589 A * 4/1986 Kasevich ..... E21B 36/04 166/248
4,790,375 A 12/1988 Bridges et al.
7,431,076 B2 10/2008 Sandberg et al.
7,441,597 B2 10/2008 Kasevich
7,860,377 B2 12/2010 Vinegar et al.
7,940,151 B2 5/2011 Parsche et al.
2004/0149443 A1* 8/2004 La Rovere ..... E21B 33/14 166/302
2010/0078163 A1 4/2010 Banerjee et al.
2010/0294489 A1 11/2010 Dreher, Jr. et al.
2012/0018140 A1* 1/2012 Parsche ..... E21B 43/2401 166/60
2012/0067580 A1* 3/2012 Parsche ..... E21B 43/2401 166/302
2012/0125608 A1* 5/2012 Parsche ..... E21B 43/2401 166/272.1

OTHER PUBLICATIONS

R. Tao and X. Xu, "Reducing the Viscosity of Crude Oil by Pulsed Electric and Magnetic Field", Energy and Fuels, 2006, 20, pp. 2046-2051, copyright 2006 American Chemical Society.

* cited by examiner

*Primary Examiner* — Giovanna C Wright
*Assistant Examiner* — Tara Schimpf
(74) *Attorney, Agent, or Firm* — Allen, Dyer, Doppelt, Milbrath & Gilchrist, P.A.

(57) ABSTRACT

A device for heating hydrocarbon resources in a subterranean formation having a wellbore therein may include an RF antenna configured to be positioned within the wellbore to heat the hydrocarbon resources in the subterranean formation. The device may further include a radio frequency (RF) source, and an RF transmission line coupling the RF antenna and the RF source. The RF transmission line may include ferromagnetic material. A magnetic source may be magnetically coupled to the RF transmission line and configured to magnetically saturate the ferromagnetic material.

22 Claims, 6 Drawing Sheets

HYDROCARBON RESOURCE HEATING APPARATUS INCLUDING FERROMAGNETIC TRANSMISSION LINE AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a largescale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may suffer from inefficiencies as a result of conductor losses, and impedance mismatches between the RF source, transmission line, and/or antenna. These losses become particularly acute with increased heating of the subterranean formation.

SUMMARY OF THE INVENTION

In view of the foregoing background, it is therefore an object of the present invention to provide a hydrocarbon resource heating apparatus that provides more efficient hydrocarbon resource heating.

This and other objects, features, and advantages in accordance with the present invention are provided by an apparatus for heating hydrocarbon resources in a subterranean formation having a wellbore therein. The apparatus includes a radio frequency (RF) antenna configured to be positioned within the wellbore to heat the hydrocarbon resources in the subterranean formation and an RF source. The apparatus also includes an RF transmission line coupling the RF antenna and the RF source. The RF transmission line includes ferromagnetic material. The apparatus further includes a magnetic source magnetically coupled to the RF transmission line and configured to magnetically saturate the ferromagnetic material. Accordingly, the hydrocarbon resource apparatus provides increased efficiency hydrocarbon resource heating, for example, by reducing energy losses along the RF transmission line.

The RF transmission line includes an inner conductor and an outer conductor surrounding the inner conductor. The magnetic source is magnetically coupled to the outer conductor, for example.

A method aspect is directed to a method for heating hydrocarbon resources in a subterranean formation having a wellbore therein. The method includes positioning an RF antenna within the wellbore. The method also includes positioning an RF transmission line to couple the RF antenna and an RF source. The RF transmission line includes ferromagnetic material. The method also includes magnetically coupling a magnetic source to the RF transmission line to magnetically saturate the ferromagnetic material. The method also includes supplying RF power from the RF source to the RF antenna to heat the hydrocarbon resources in the subterranean formation

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate like elements in different embodiments.

Figure 1:
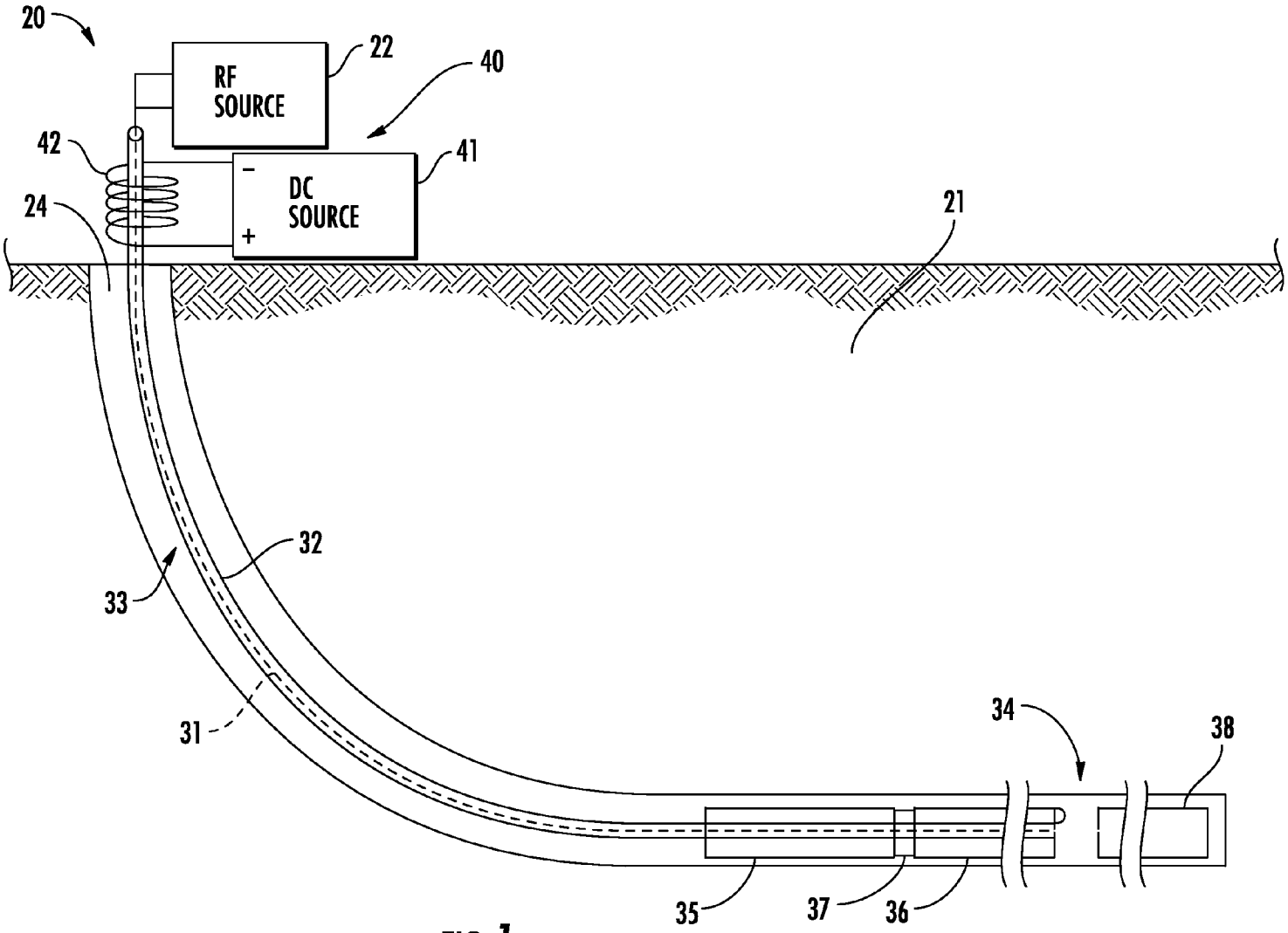
FIG. 1 is a schematic diagram of a subterranean formation including an apparatus for processing hydrocarbon resources in accordance with the present invention.
Figure 2:
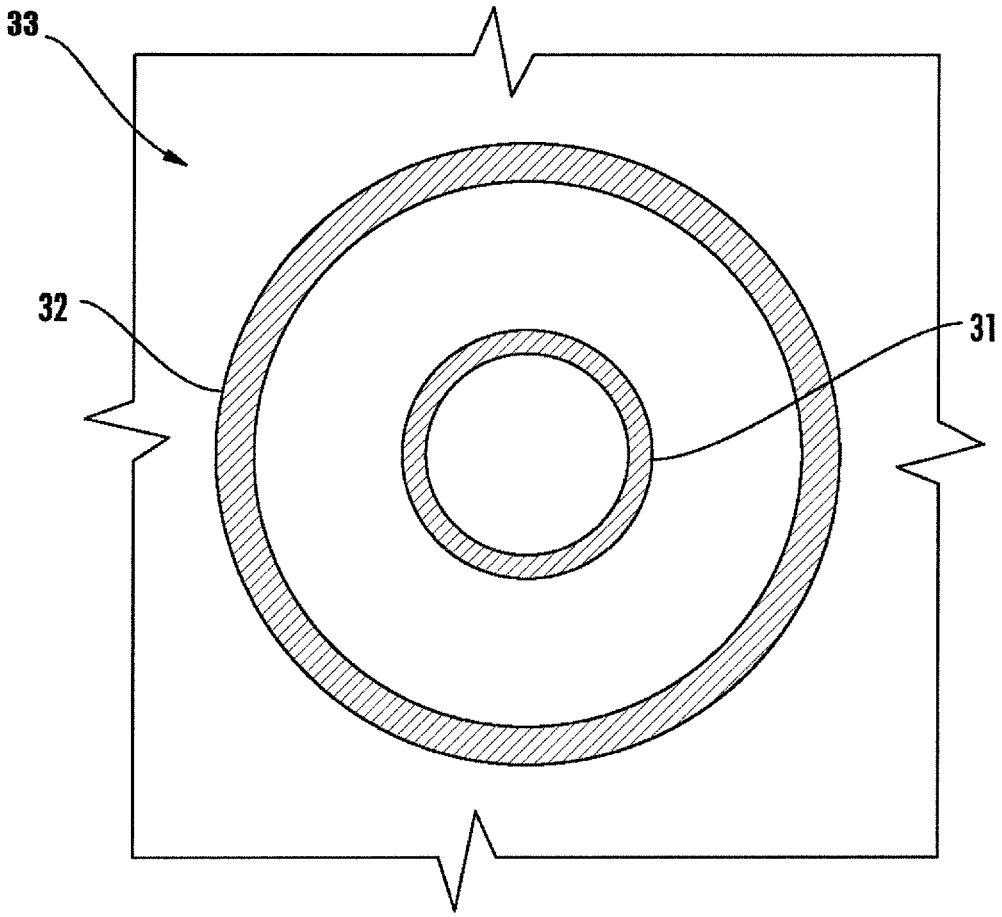
FIG. 2 is an enlarged cross-sectional view of a portion of the RF transmission line of FIG. 1.
Figure 3:
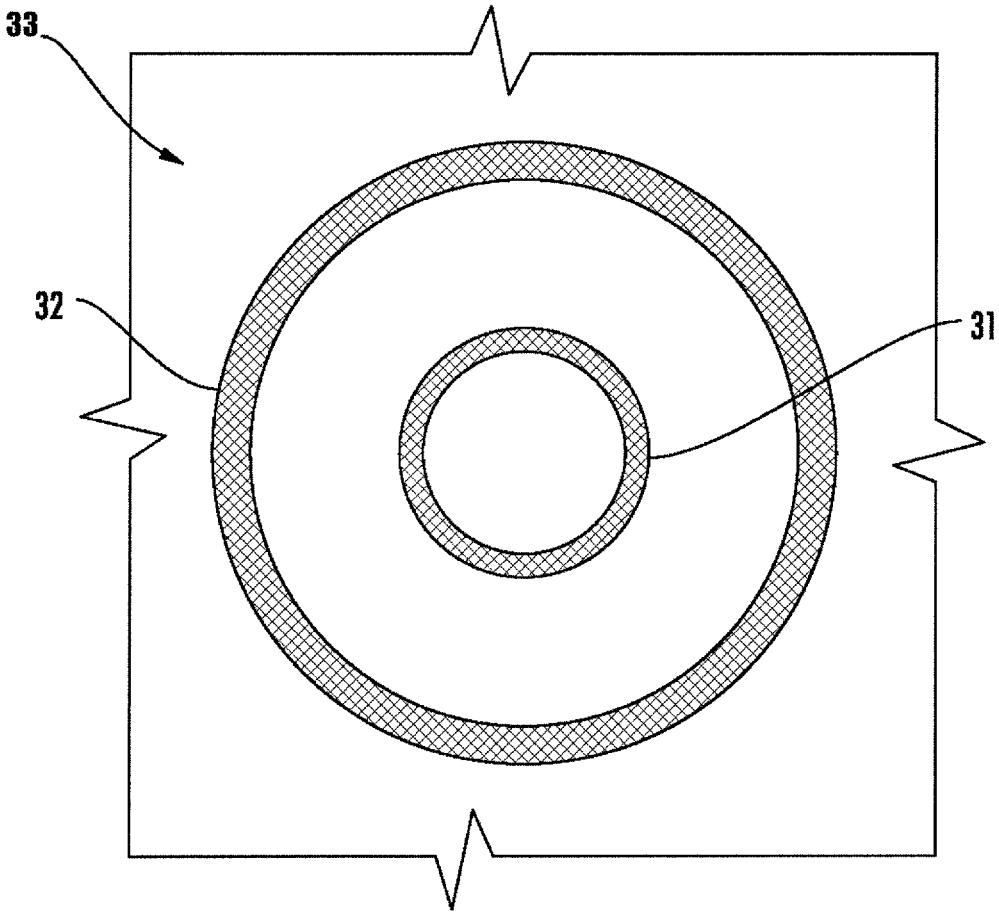
FIG. 3 is an enlarged cross-sectional view of a magnetically saturated portion of the RF transmission line of FIG. 1.

Referring initially to FIGS. 1-3, an apparatus 20 for heating hydrocarbon resources in a subterranean formation 21 is described. The subterranean formation 21 includes a wellbore 24 therein. The wellbore 24 illustratively extends laterally within the subterranean formation 21. In some embodiments, the wellbore 24 may be a vertically extending wellbore, for example, and may extend vertically in the subterranean formation 21. Although not shown, in some embodiments a second or producing wellbore may be used below the wellbore 24, such as would be found in a SAGD implementation, for the collection of oil, etc., released from the subterranean formation 21 through heating. The apparatus 20 also includes a radio frequency (RF) source 22.

An RF antenna 34 is within the wellbore 24 and cooperates with the RF source 22 to heat the hydrocarbon resources in the subterranean formation 21. An RF transmission line 33 couples the RF antenna 34 and the RF source 22. The RF transmission line 33 may be in the form of a shielded transmission line, such as, for example, a coaxial RF transmission line which includes an inner conductor 31 and an outer conductor 32 concentrically surrounding the inner conductor. The RF transmission line 33 includes ferromagnetic material. In particular, the inner and outer conductors 31, 32 may include ferromagnetic material.

The RF antenna 34 is in the form of an RF dipole antenna and is coupled to a distal end of the RF coaxial transmission line 33. A first electrically conductive sleeve 35 surrounds and is spaced apart from the RF coaxial transmission line 33 defining a balun. A second electrically conductive sleeve 36 surrounds and is spaced apart from the coaxial RF transmission line 33. In some embodiments, a dielectric spacer 37 may be coupled between first and second electrically conductive sleeves 35, 36. The outer conductor 32 of the RF coaxial transmission line 33 is coupled to the second electrically conductive sleeve 36 at a distal end of the RF coaxial transmission line defining a leg of the RF dipole antenna 34. A third electrically conductive sleeve 38 is coupled to the inner conductor 31 defining another leg of the RF dipole antenna 34. Of course, while an RF dipole antenna 34 is described herein, it will be appreciated that other types of RF antennas may be used, and may be configured with the RF transmission line in other arrangements.

The RF antenna 34 also includes ferromagnetic material. For example, one or more of the legs of the RF dipole antenna 34 may include ferromagnetic material. Additionally, gaps between legs of the RF dipole antenna 34, the RF transmission line 33, and the balun 35 may be filled with a ferrite.

A magnetic source 40 is magnetically coupled to the RF transmission line 33 above the subterranean formation 21. In some embodiments, the magnetic source 40 may be coupled below the subterranean formation 21. More particularly, the magnetic source 40 may be a source of steady state magnetic fields or streams of pulsed steady state magnetic fields. Also, more than one magnetic source may be coupled to the RF transmission line 33, for example, above and below the subterranean formation 21.

The magnetic source 40 is magnetically coupled to the outer conductor 32 and magnetically saturates the ferromagnetic material in the outer conductor. In particular, the magnetic source 40 is an electromagnet and includes a plurality of windings 42 adjacent the RF transmission line 33 coupled to a direct current (DC) source 41. During operation of the DC source 41, the ferromagnetic material of the RF transmission line 33 becomes magnetically saturated, as illustrated in FIG. 3.

Figure 4:
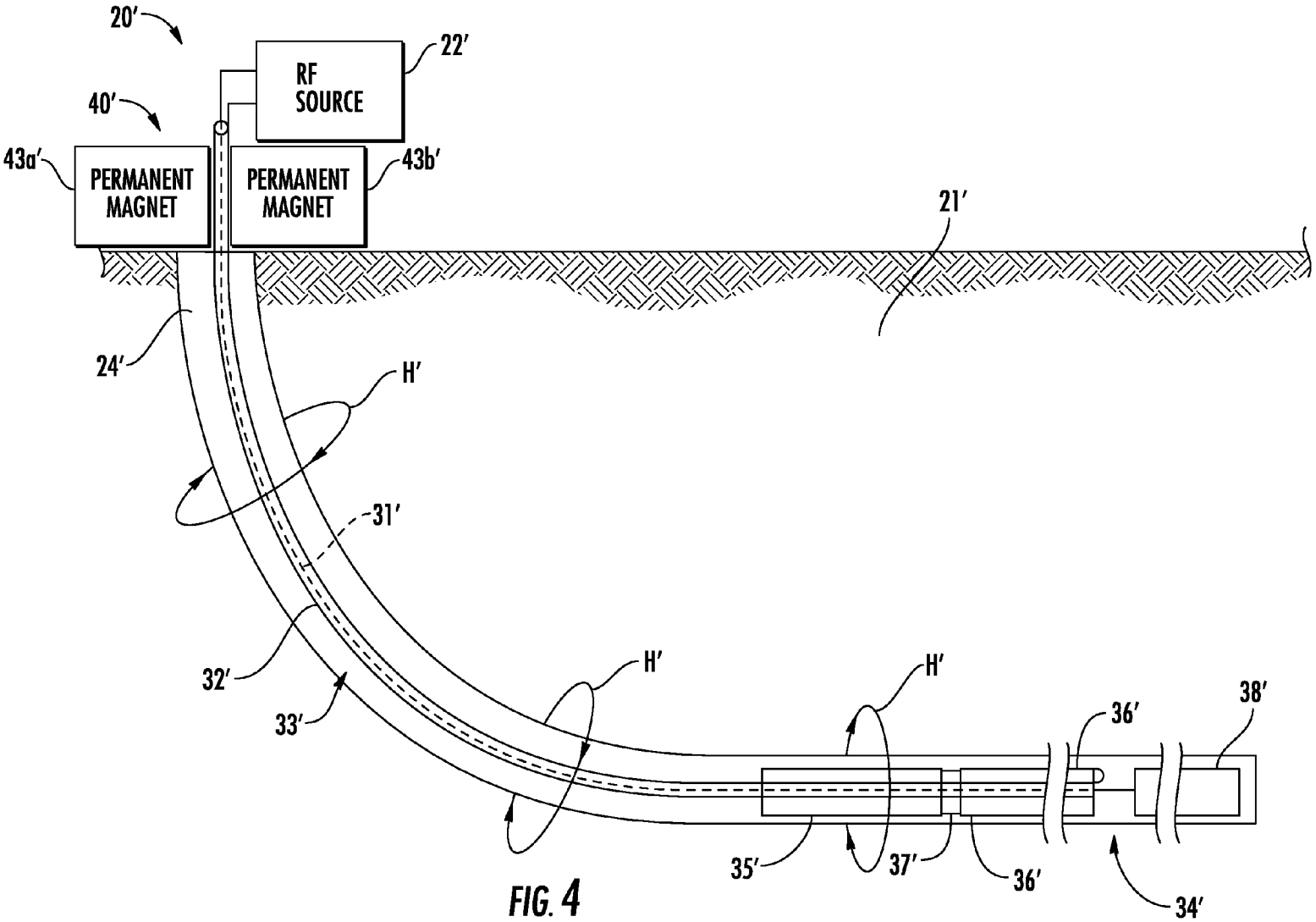
FIG. 4 is a schematic diagram of a subterranean formation including an apparatus for processing hydrocarbon resources in accordance with another embodiment of the present invention

In some embodiments, for example, as illustrated in FIG. 4, the magnetic source 40' may include permanent magnets 43*a*', 43*b*' adjacent the RF transmission line 33'. Of course, the permanent magnets 43*a*', 43*b*' may be positioned anywhere along or adjacent to the RF transmission line 33' to magnetically saturate the ferromagnetic material, as illustrated by the magnetic field H'. The permanent magnets 43*a*', 43*b*' may be within the wellbore 24', or above or below the subterranean formation 21'.

An RF transmission line, for example, that may be defined by steel or carbon-steel pipes is magnetic. Using a carbon-steel pipe, for example, may be particularly advantageous for reducing costs of hydrocarbon resource recovery, retrofitting older wells, and/or reducing corrosion, for example, galvanic corrosion, of pipes in adjacent wellbores. However, since carbon-steel is magnetic, RF losses are increased relative to copper because of increased resistance by currents carried along the surface, and this is known as the magnetic skin effect. In a conductive and magnetically permeable material, such as carbon steel, for example, radio frequency electric currents are forced to the surface due to magnetic skin effect. The magnetic skin effect is in addition to the radio frequency skin effect seen in nonmagnetic conductors such as copper.

In particular, the depth of RF electric current penetration in a conductor is defined by the variable 5 such that:

$$\delta=\sqrt{(2\rho)/(\omega\mu_r)}$$

where:

$\rho$=resistivity of the conductor;

$\omega$=angular frequency of the current=(2Π)(frequency); and $\mu_r$=relative magnetic permeability of the conductor.

Thus, the magnetic skin depth is proportional to the reciprocal of the square root of the relative magnetic permeability. A typical carbon steel may have a relative magnetic permeability $\mu_r$=400, so the magnetic permeability there reduces the RF electric current penetration by a factor of $1/\sqrt{400}=0.05$. In other words, the relative magnetic permeability of carbon steel may increase the electrical resistance of a carbon steel pipe by a factor of 20 at radio frequencies.

By magnetizing the steel pipe or RF transmission line 33, currents are driven deeper from the surface of RF transmission line. In other words, applying a steady state magnetic field to bias the ferromagnetic material of the RF transmission line 33 reduces the magnetic permeability, which reduces skin depth. This in turn may put more material to work in conducting the electric current.

The DC magnetic field constrains the magnetic domains. The magnetized carbon-steel, for example, may be less responsive to the RF magnetic fields. Increased magnetic permeability is typically undesirable, thus it may be particularly advantageous to magnetically saturate the ferromagnetic material with a quiescent magnetic field such that the RF magnetic permeability is greatly reduced. Accordingly, resistance heating losses from the RF currents are reduced which may result in increased power savings, faster speed and greater penetration of the subterranean RF heating. This is because induction heating of the earth by application of radio frequency electric and magnetic fields is much faster that conducted heating. Additionally, the use of copper, for example, which may be desirable for handling increased RF currents and heat generated by the increased resistance, may be reduced or even eliminated.

Magnetization occurs when the magnetic domains in a material start to line up. Saturation occurs when all the domains are lined up and an increase in the external biasing magnetic field cannot further increase the magnetization of the material, so that the total magnetic flux density B levels off. It is not necessary to magnetically saturate the RF transmission line 33 material to cause reduction in resistance losses. Saturation occurs most notably in ferromagnetic materials such as iron, nickel, cobalt, and their alloys. The present invention works by capturing some or all of the ferromagnetic material domains with the steady state/DC/quiescent biasing magnetic field, to prevents the RF electric current induced magnetic fields from capturing the domains.

While the present invention is primarily directed towards the reduction of conductor joule effect losses, the magnetic fields conveyed to the subterranean formation 21 may favorably modify the rheological properties of subterranean oil by agglomeration of asphalt particles to reduce oil viscosity.

A prototype apparatus was formed to demonstrate to concepts described above, and more particularly, to demonstrate reduced losses in magnetically biased and magnetically saturated carbon-steel. The prototype apparatus was formed as a magnetically biased fork resonator similar to that described in U.S. Pat. No. 8,450,664, to Parsche, assigned to the present assignee, and the entire contents of which are hereby incorporated by reference. The fork resonator included two parallel elongate conductors, closed at one end to form a U shape ¼ wave stub of open wire transmission line. vCopper electromagnet windings to apply the DC magnetic field bias were placed around the closed circuit end of the U shaped resonator fork. A second conductive loop, held nearby the U shaped resonator for was inductively coupled to the first loop defining a transformer feed coupling.

It is worth noting that it may be particularly difficult to measure a change in milliohms of resistance in a relatively short section of a well pipe, for example. To demonstrate this effect, the bandwidth change of the magnetically biased fork resonator was measured. The fork included a sensitive high Q resonant circuit so changes in the small value conductor resistance were readily discerned. A decreased impedance bandwidth and voltage standing wave ratio (VSWR) corresponds to reduced conductor losses, as reduced conductor loss occurs from the parallel elongate conductors.

Figure 5:
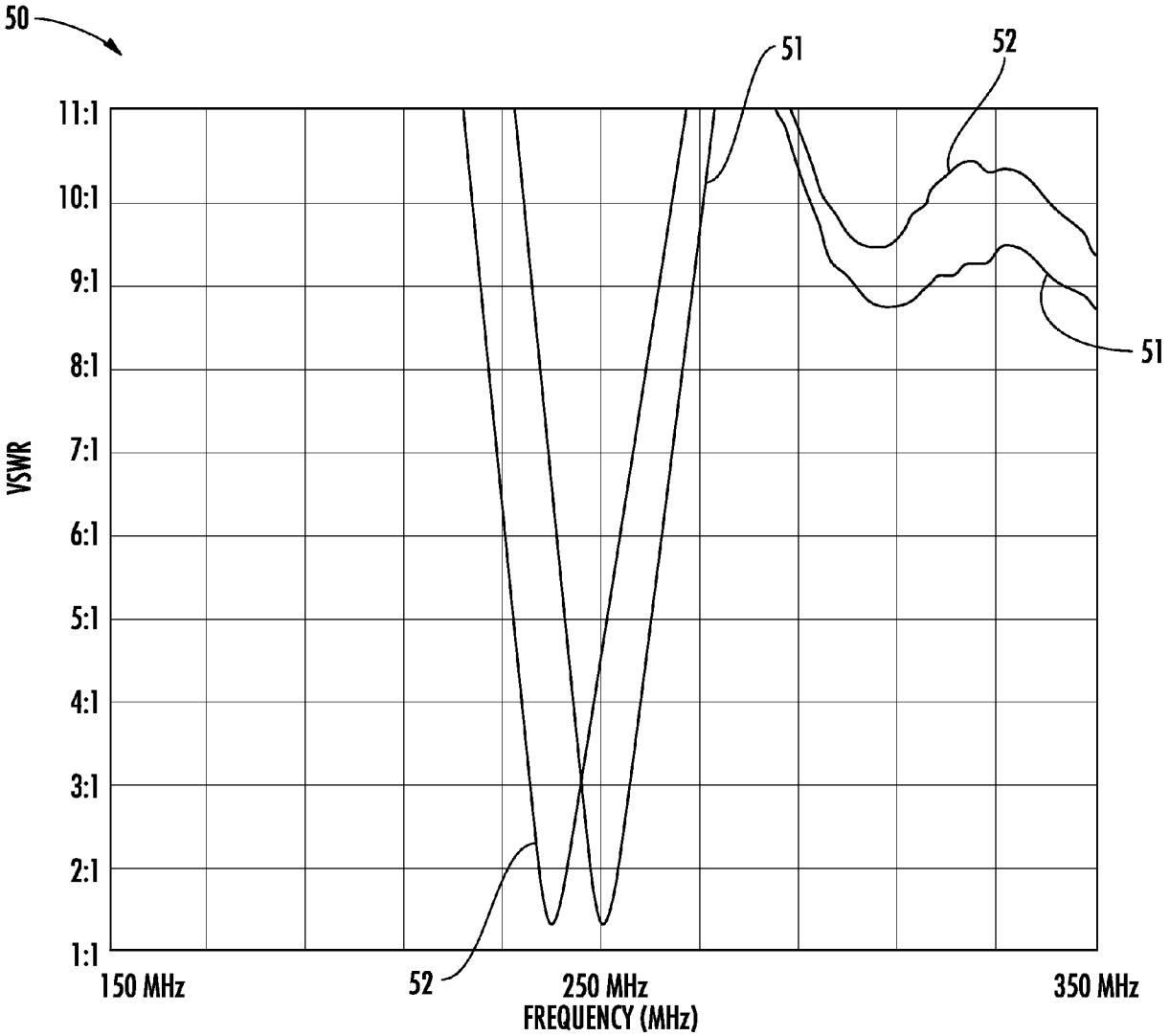
FIG. 5 is a graph of measured voltage standing wave ratio (VSWR) from a prototype apparatus based upon the present invention.

Referring now to the graph 50 in FIG. 5, the VSWR response of the prototype carbon steel antenna fork is illustrated with 51 and without 52 direct current (DC) magnetic fields applied so that the ferromagnetic material is saturated. The steady state magnetic fields bias reduced the bandwidth of the carbon steel resonator fork because the conductor losses were reduced.

The table below summarizes expected performance of the apparatus 20 based upon the prototype.

| Parameter | Value | Notes |
|---|---|---|
| Pipe material | Carbon-steel | American Petroleum Institute (API) tubing |
| Initial relative permeability $\mu_i$ | 450 | |
| Magnetically biased relative permeability $\mu_{bias}$ | 9 | |
| RF resistance reduction | 7.1 | $=\sqrt{(u_i/u_{bias})}=\sqrt{(450/9)}=7.1$ |

A method aspect is directed to a method for heating hydrocarbon resources in a subterranean formation 21 having a wellbore 24 therein. The method includes positioning the RF antenna 34 within the wellbore 24. The method also includes positioning the RF transmission line 33 to couple the RF antenna 34 and an RF source 22. The RF transmission line 33 includes ferromagnetic material. The method also includes magnetically coupling the magnetic source 40 to the RF transmission line 33 to magnetically saturate the ferromagnetic material. RF power is supplied from the RF source 22 to the RF antenna 34 to heat the hydrocarbon resources in the subterranean formation 21.

Figure 6:
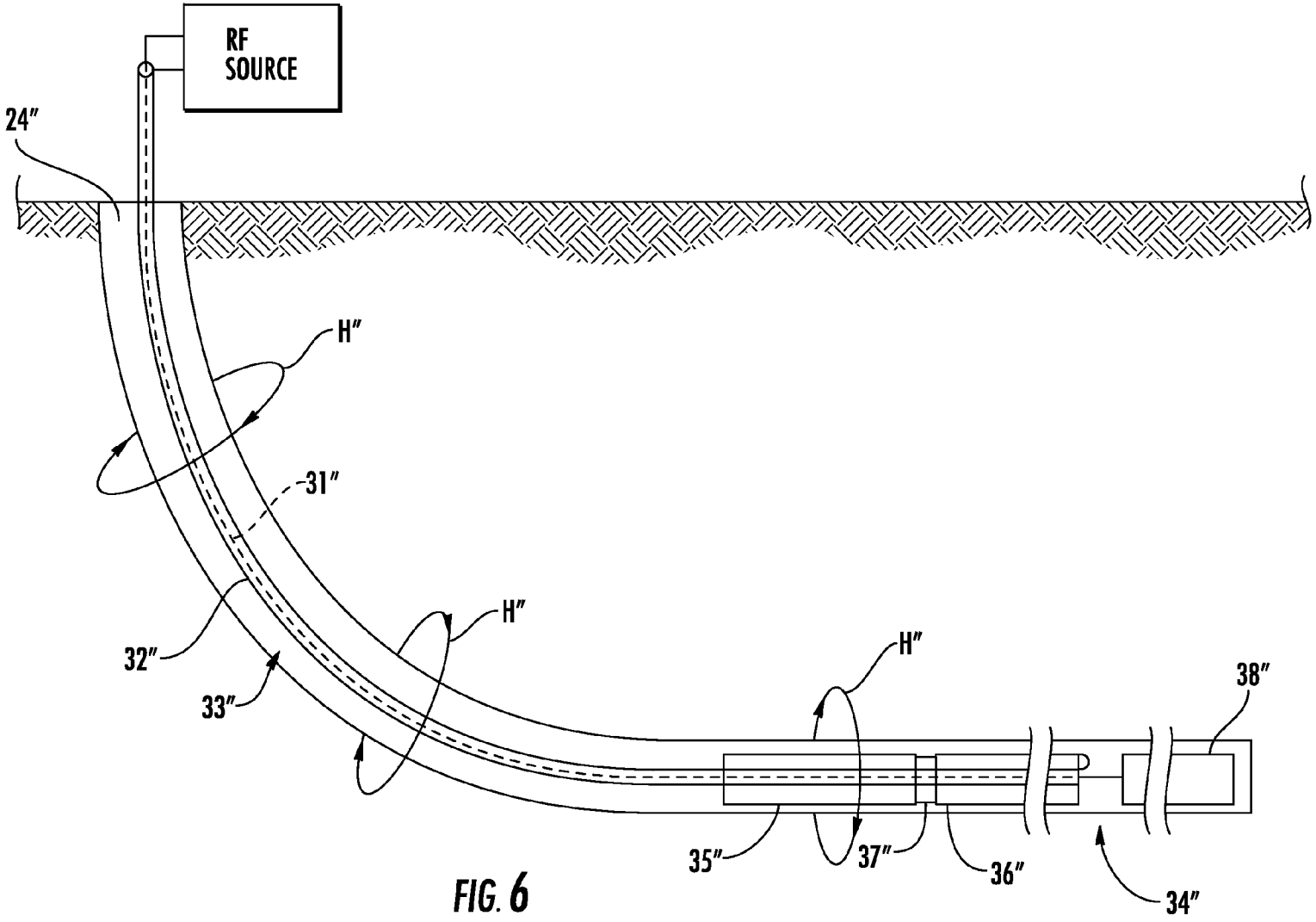
FIG. 6 is a schematic diagram of a subterranean formation including an apparatus for processing hydrocarbon resources in accordance with another embodiment of the present invention.

Referring now to FIG. 6, in another embodiment, the apparatus 20" includes a magnetized RF transmission line 33". The magnetized RF transmission line 33" includes magnetically saturated ferromagnetic material. In other words, a magnetic source may not be included. In particular, the magnetized RF transmission line 33" may be permanently magnetized so that the ferromagnetic material is permanently magnetically saturated as illustrated by the magnetic fields H". The ferromagnetic material may be magnetized or permanently magnetized by way remnant magnetization, flashing of the RF transmission line 33", and/or applying a permanent magnetic field from a permanent magnet adjacent the RF transmission line either in-situ or prior to being positioned in the wellbore 24". The ferromagnetic material may be magnetized, for example, permanently magnetized by applying pulses of DC current to the biasing electromagnet. The RF transmission line 33" materials may be selected to be remnant magnetic materials to retain permanent magnetism.

A related method aspect is directed to a method of heating hydrocarbon resources in a subterranean formation 21" having a wellbore 24" therein. The method includes positioning the radio frequency (RF) antenna 33" within the wellbore 24". The method also includes coupling the magnetized RF transmission line 33" between the RF antenna 34" and an RF source 22". The RF magnetized transmission line 33" includes magnetically saturated ferromagnetic material. RF power is supplied from the RF source 22" to the RF antenna 34" to heat the hydrocarbon resources in the subterranean formation 21". The heating mechanisms applied to the subterranean formation 21" may include, for example, joule effect from magnetic field induced eddy electric currents, joule effect from electric fields capacitively coupling electric currents, and While several embodiments with respect to saturating the ferromagnetic material have been described herein, the ferromagnetic material may be biased or saturated using more than one of the above-described techniques. For example, an electromagnetic winding may be used in conjunction with a permanent magnet, and/or permanently magnetizing the RF transmission line so that the magnetism is constant, e.g., a quiescent/DC/steady state magnetic field is provided.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for heating hydrocarbon resources in a subterranean formation having a wellbore therein, the apparatus comprising:

a radio frequency (RF) antenna configured to be positioned within the wellbore to heat the hydrocarbon resources in the subterranean formation;

an RF source configured to generate RF energy;

an electrically conductive RF transmission line coupling said RF antenna and said RF source, said electrically conductive RF transmission line comprising at least one conductor having ferromagnetic material; and a magnetic source magnetically coupled to said electrically conductive RF transmission line and configured to generate a magnetic field independently from said RF source to magnetically saturate the ferromagnetic material.

2. The apparatus according to claim 1, wherein said at least one conductor comprises an inner conductor and an outer conductor surrounding said inner conductor.

3. The apparatus according to claim 2, wherein said magnetic source is magnetically coupled to said outer conductor.

4. The apparatus according to claim 1, wherein said magnetic source comprises an electromagnet.

5. The apparatus according to claim 4, wherein said electromagnet comprises a plurality of windings adjacent said electrically conductive RF transmission line.

6. The apparatus according to claim 1, wherein said magnetic source comprises a permanent magnet adjacent said electrically conductive RF transmission line.

7. The apparatus according to claim 1, wherein said magnetic source is coupled to said RF antenna above the subterranean formation.

8. The apparatus according to claim 1, wherein said RF antenna comprises an RF dipole antenna.

9. An apparatus for heating hydrocarbon resources in a subterranean formation having a wellbore therein, the apparatus comprising:

a radio frequency (RF) antenna configured to be positioned within the wellbore to heat the hydrocarbon resources in the subterranean formation;

an RF source configured to generate RF energy;

an electrically conductive RF transmission line coupling said RF antenna and said RF source, said electrically conductive RF transmission line comprising an inner conductor and an outer conductor surrounding said inner conductor, at least said outer conductor comprising ferromagnetic material; and an electromagnet magnetically coupled to said RF transmission line and configured to generate a magnetic field independently from said RF source to magnetically saturate the ferromagnetic material.

10. The apparatus according to claim 9, wherein said electromagnet comprises a plurality of windings adjacent said outer conductor.

11. The apparatus according to claim 9, wherein said electromagnet is coupled to said RF antenna above the subterranean formation.

12. The apparatus according to claim 9, wherein said RF antenna comprises an RF dipole antenna.

13. A method for heating hydrocarbon resources in a subterranean formation having a wellbore therein, the method comprising:

positioning a radio frequency (RF) antenna within the wellbore;

positioning an electrically conductive RF transmission line to couple the RF antenna and an RF source, the electrically conductive RF transmission line comprising at least one conductor having ferromagnetic material;

magnetically coupling a magnetic source to the RF transmission line to generate a magnetic field independently from the RF source to magnetically saturate the ferromagnetic material; and supplying RF power from the RF source to the RF antenna to heat the hydrocarbon resources in the subterranean formation.

14. The method according to claim 13, the at least one conductor comprises an inner conductor and an outer conductor surrounding the inner conductor.

15. The method according to claim 14, wherein magnetically coupling the magnetic source comprises magnetically coupling the magnetic source to the outer conductor.

16. The method according to claim 13, wherein magnetically coupling the magnetic source comprises magnetically coupling an electromagnet.

17. The method according to claim 13, wherein magnetically coupling the magnetic source comprises magnetically coupling a permanent magnet adjacent the electrically conductive RF transmission line.

18. The method according to claim 13, wherein magnetically coupling the magnetic source comprises magnetically coupling the magnetic source to the RF antenna above the subterranean formation.

19. An apparatus for heating hydrocarbon resources in a subterranean formation having a wellbore therein, the apparatus comprising:

a radio frequency (RF) antenna configured to be positioned within the wellbore to heat the hydrocarbon resources in the subterranean formation;

an RF source; and an electrically conductive permanently magnetized RF transmission line coupling said RF antenna and said RF source, said electrically conductive permanently magnetized RF transmission line comprising electrically conductive permanently magnetically saturated ferromagnetic material.

20. The apparatus according to claim 19, wherein said electrically conductive permanently magnetized RF transmission line comprises an inner conductor and an outer conductor surrounding said inner conductor.

21. The apparatus according to claim 19, wherein said RF antenna comprises an RF dipole antenna.

22. A method of heating hydrocarbon resources in a subterranean formation having a wellbore therein, the method comprising:

positioning a radio frequency (RF) antenna within the wellbore;

coupling an electrically conductive permanently magnetized RF transmission line between the RF antenna and an RF source, the electrically conductive permanently magnetized RF transmission line comprising electrically conductive permanently magnetically saturated ferromagnetic material; and supplying RF power from the RF source to the RF antenna to heat the hydrocarbon resources in the subterranean formation.

* * * * *